US010190320B2

(12) United States Patent
Naylor et al.

(10) Patent No.: US 10,190,320 B2
(45) **Date of Patent: *Jan. 29, 2019**

(54) EXTERIOR CLADDING SYSTEM

(71) Applicant: BŌK MODERN, LLC, San Francisco, CA (US)

(72) Inventors: Russell Naylor, San Francisco, CA (US); Hearee Chu, San Francisco, CA (US)

(73) Assignee: BŌK Modern LLC, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/870,425

(22) Filed: Jan. 12, 2018

(65) Prior Publication Data

US 2018/0171639 A1 Jun. 21, 2018

Related U.S. Application Data

(63) Continuation of application No. 15/136,697, filed on Apr. 22, 2016, now Pat. No. 9,903,122.

(60) Provisional application No. 62/152,369, filed on Apr. 24, 2015.

(51) Int. Cl.
*E04F 13/08* (2006.01)
*E04F 13/12* (2006.01)

(52) U.S. Cl.
CPC ..... *E04F 13/0805* (2013.01); *E04F 13/0846* (2013.01); *E04F 13/12* (2013.01)

(58) Field of Classification Search
CPC .... E04F 13/0805; E04F 13/12; E04F 13/0846
See application file for complete search history.

(56) References Cited

U.S. PATENT DOCUMENTS 841,490 A * 1/1907 Montier ..... 52/591.2
1,064,091 A * 6/1913 Scheu ..... E04F 13/0864 52/506.01
1,582,611 A * 4/1926 Kane ..... E04B 1/08 52/509
1,696,443 A * 12/1928 Michaelis ..... E04F 13/12 52/241
1,980,906 A * 11/1934 Bretland ..... E04F 13/12 404/40

(Continued)

FOREIGN PATENT DOCUMENTS

CA 2220422 A1 * 5/1999 ..... E04F 13/0864
FR 3008439 B1 * 12/2015 ..... E04F 13/0803

*Primary Examiner* — Jeanette E Chapman
(74) *Attorney, Agent, or Firm* — Run8 Patent Group, LLC; Peter Miller

(57) ABSTRACT

One variation of an exterior cladding system includes a set of panels including a first panel and a second panel, each panel in the set of panels including: a face; an upper flange extending from an upper edge of the face and defining a receiver; a hang tab extending from the upper flange substantially parallel to the face, offset from the face by a first depth, and defining a fastener bore; a lower flange extending from a lower edge of the face; a lock tab extending from the lower flange opposite the upper flange by a first height and offset from the face by a second depth less than the first depth; and a striker extending from the lower flange opposite the upper flange by a second height less than the first height.

2 Claims, 11 Drawing Sheets

(56) References Cited

U.S. PATENT DOCUMENTS

| | | | | | |
|---|---|---|---|---|---|
| 2,061,263 | A * | 11/1936 | Wells | E04F 13/12 | 52/211 |
| 2,106,315 | A * | 1/1938 | Brooks | E04F 13/12 | 52/468 |
| 2,649,172 | A * | 8/1953 | Allen | E04C 2/08 | 52/591.4 |
| 2,676,481 | A * | 4/1954 | Hoffman | E04F 13/0803 | 277/641 |
| 5,522,193 | A * | 6/1996 | Sommerstein | E04F 13/081 | 52/235 |
| 8,316,606 | B2 * | 11/2012 | Siewert | E04F 13/10 | 52/483.1 |
| 9,045,909 | B1 * | 6/2015 | Preuss | E04F 13/0864 | |
| 9,903,122 | B2 * | 2/2018 | Naylor | E04F 13/0805 | |

* cited by examiner 100
1E
114
112
110

100
1F
102
1I
104
118
116
124
122

100
114
122
120

100
1G
1H 100
112
110

100
104
118
116

100
116
110
104

100
104
122
120
124

100
104
124
122
124

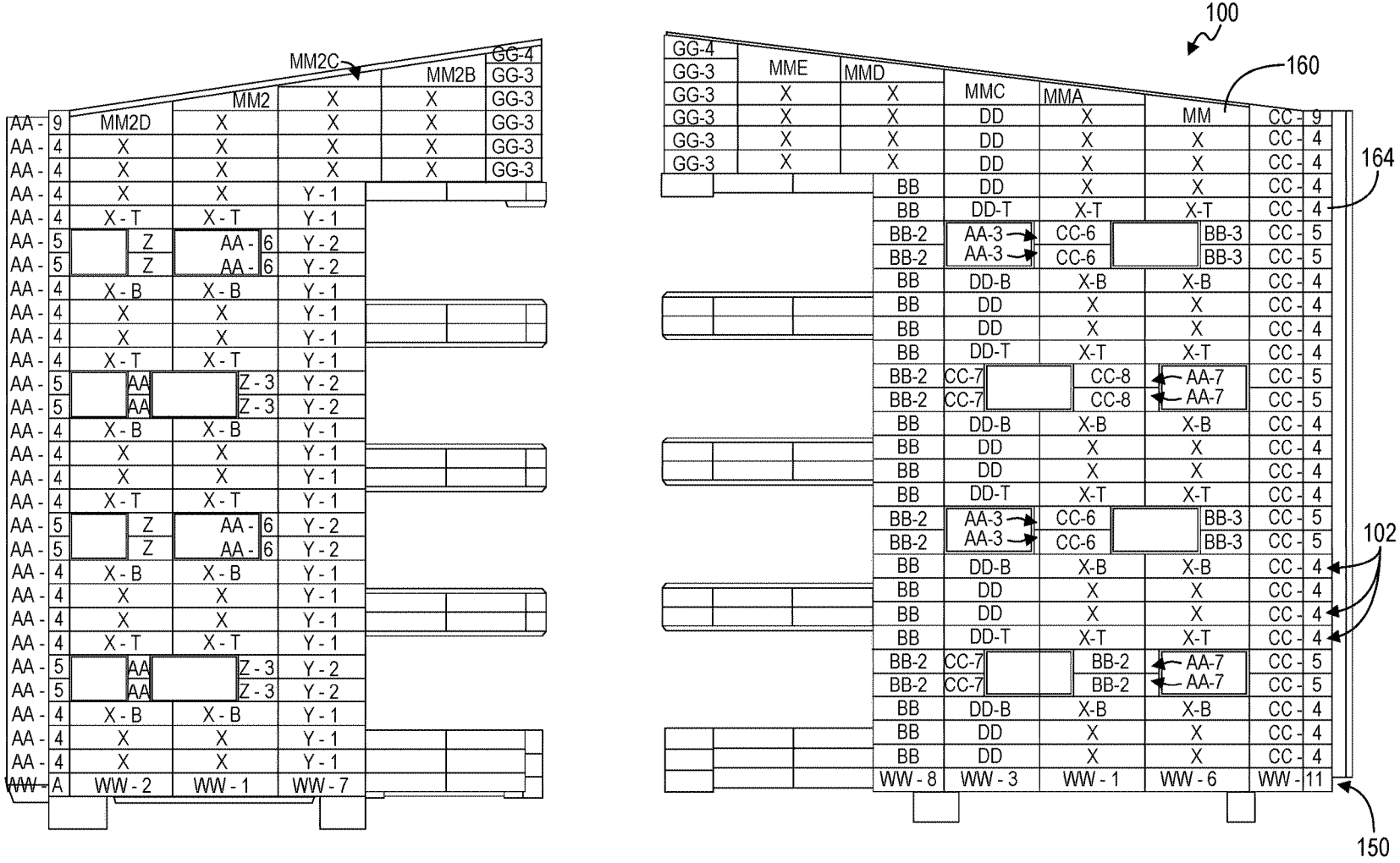
100
160
164
102
150
MM2C
MM2D
MM2
MM2B
MMA
MMC
MMD
MME
MM
GG-4
GG-3
GG-3
GG-3
GG-3
GG-3
AA-9
AA-4
AA-4
AA-4
AA-4
AA-4
AA-5
AA-5

EXTERIOR CLADDING SYSTEM

CROSS-REFERENCE TO RELATED APPLICATIONS

This Application is a continuation of U.S. patent application Ser. No. 15/136,697, filed on 22 Apr. 2016, which claims the benefit of U.S. Provisional Application No. 62/152,369, filed on 24 Apr. 2015, both of which are incorporated in their entireties by this reference.

TECHNICAL FIELD

This invention relates generally to the field of rainscreen systems and more specifically to a new and useful exterior cladding system in the field of rainscreen systems.

BRIEF DESCRIPTION OF THE FIGURES

FIG. 8 is a schematic representation of one variation of the exterior cladding system;

DESCRIPTION OF THE EMBODIMENTS

Figures 1A, 1B, 1C, 1D, 1E, 1F, 1G, 1H, 1I:
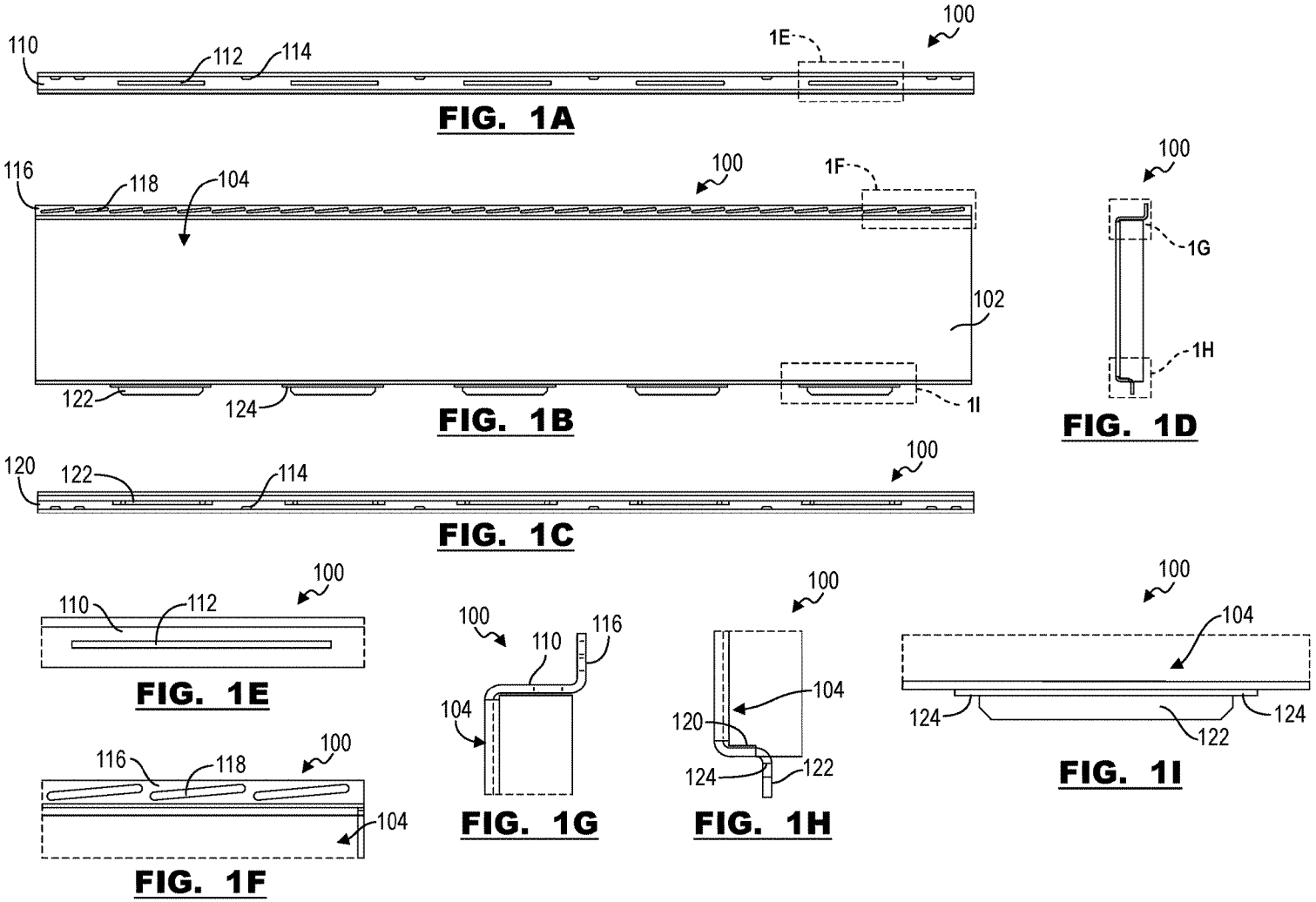
FIGS. 1A, 1B, 1C, 1D, 1E, 1F, 1G, 1H, and 1I are schematic representations of a panel within an exterior cladding system.

The following description of the embodiments of the invention is not intended to limit the invention to these embodiments but rather to enable a person skilled in the art to make and use this invention.

1. Exterior Cladding System

As shown in FIGS. 1A-1I, an exterior cladding system 100 includes: a set of panels including a first panel and a second panel, the first panel configured for installation adjacent the second panel. Each panel 102 in the set of panels includes a folded metal structure defining: a face 104; an upper flange 110; a hang tab 116; a lower flange 120; a lock tab 122; and a striker 124. The upper flange 110 extends from an upper edge of the face 104 and defines a receiver 112. The hang tab 116 extends from the upper flange no substantially parallel to the face 104 and at a first depth from the face 104 and defines a fastener bore 118. The lower flange 120 extends from a lower edge of the face 104. The lock tab 122 extends from the lower flange 120 at a second depth from the face 104 less than the first depth and extends from the lower flange 120 by a first height. The striker 124 extends from the lock tab 122 at a second height from the lower flange 120 less than the first height. The first panel is configured to hang from a first fastener passing through the fastener bore 118 in the first panel and set into a wall structure. The second panel is configured to hang from a second fastener passing through the fastener bore 118 in the second panel and set into the wall structure with the lock tab 122 of the second panel passing through and constrained by the receiver 112 of the first panel and with the striker 124 of the second panel contacting the upper flange 110 of the first panel to set a gap between the upper edge of the first panel and the lower edge of the second panel.

As shown in FIG. 1, one variation of the exterior cladding system 100 includes a set of panels, including a first panel and a second panel. Each panel 102 in the set of panels includes: a face 104; an upper flange 110 extending from an upper edge of the face 104 and defining a receiver 112; a hang tab 116 extending from the upper flange no substantially parallel to the face 104, offset from the face 104 by a first depth, and defining a fastener bore 118; a lower flange 120 extending from a lower edge of the face 104; a lock tab 122 extending from the lower flange 120 opposite the upper flange 110 by a first height and offset from the face 104 by a second depth less than the first depth; and a striker 124 extending from the lower flange 120 opposite the upper flange 110 by a second height less than the first height. The first panel is configured to hang from a first fastener passing through the fastener bore 118 in the first panel and into a wall structure; and the second panel is configured to hang from a second fastener passing through the fastener bore 118 in the second panel and into the wall structure with the lock tab 122 of the second panel passing through and constrained by the receiver 112 of the first panel and with the striker 124 of the second panel contacting the upper flange 110 of the first panel to set a gap between the upper edge of the first panel and the lower edge of the second panel.

Figure 9:
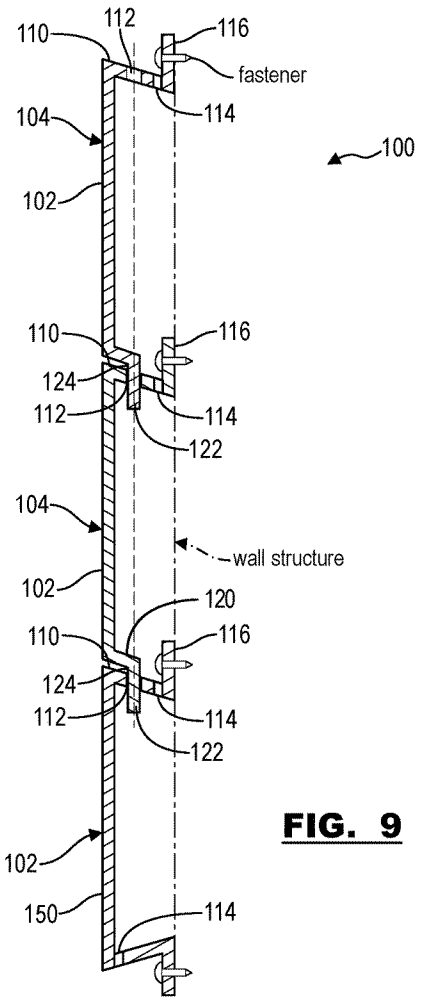
FIG. 9 is a schematic representation of one variation of the exterior cladding system.

As shown in FIG. 9, another variation of the exterior cladding system 100 includes a first panel and a second panel. In this variation, the first panel includes: a first face; a first upper flange 110 extending from a first upper edge of the first face, declining away from the first face, and defining a first receiver 112 and a first drainage port 114; and a first hang tab 116 extending from the first upper flange 110 substantially parallel to the first face, offset from the first face by a first depth, and defining a first fastener bore 118. The first panel is configured to hang from a first fastener passing through the first fastener bore 118 and into an adjacent wall structure. The second panel includes: a second face; a second upper flange 110 extending from a second upper edge of the second face, declining away from the second face, defining a second receiver 112 and a second drainage port 114; and a second hang tab 116 extending from the second upper flange no substantially parallel to the second face, offset from the second face by the first depth, and defining a second fastener bore 118. The second panel is configured to hang from a second fastener passing through the second fastener bore 118 and into the adjacent wall structure. The second panel also includes: a second lower flange 120 extending from a second lower edge of the second face and declining away from the second face and configured to collect fluid passing down the second face; and a second lock tab 122 extending from the second lower flange 120 opposite the second upper flange 110 by a first height, offset from the second face by a second depth less than the first depth, configured to pass through the first receiver 112 of the first panel to constrain the second lower flange 120 of the second panel, and configured to cooperate with the second lower flange 120 to deposit fluid onto the first flange of the first panel between the first hang tab 116 and the first face.

2. Applications

Figure 2:
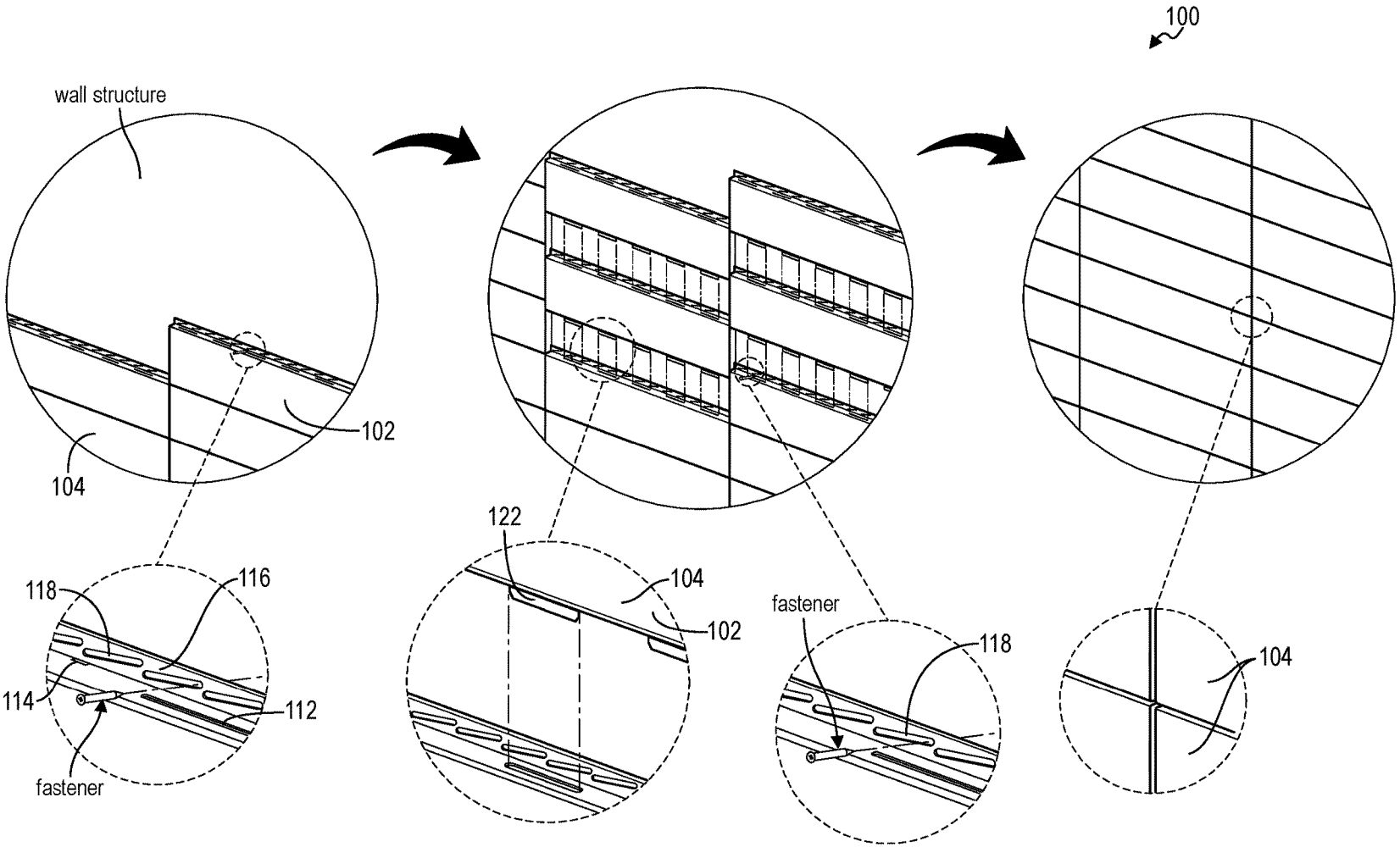
FIG. 2 is a flowchart representation of one variation of the exterior cladding system.

The exterior cladding system 100 includes a set of panels that can be installed over an exterior wall to form an exterior façade of a building or other structure. A set of panels in the exterior cladding system 100 can be installed over a (substantially) vertical exterior wall structure to form a rigid, concealed-fastener façade over and offset from the wall structure (hereinafter an "installation"), as shown in FIG. 2. When thus installed over a wall structure, the set of panels can protect a vapor barrier covering over the wall structure both from mechanical damage (e.g., by impact) and from sun damage; the set of panels can also maintain an air gap and permit air flow around the outer face of the vapor barrier to improve drying following environmental temperature changes, rainfall, and/or snowfall, etc. A panel in the exterior cladding system 100 can also include upper and lower flanges that decline away from the face of the panel in order to draw moisture—collecting on the face and on faces of other panels above—into the air gap between the wall structure and the panels, and the upper and/or lower flanges in the panels can include drainage ports that funnel such moisture downward toward the base of the wall structure, thereby reducing flow of moisture on the faces of the panels, reducing contamination of the faces of the panels by water-borne and airborne detritus, and maintaining relative cleanliness of the faces of the panels in the installation over time.

Figure 3A:
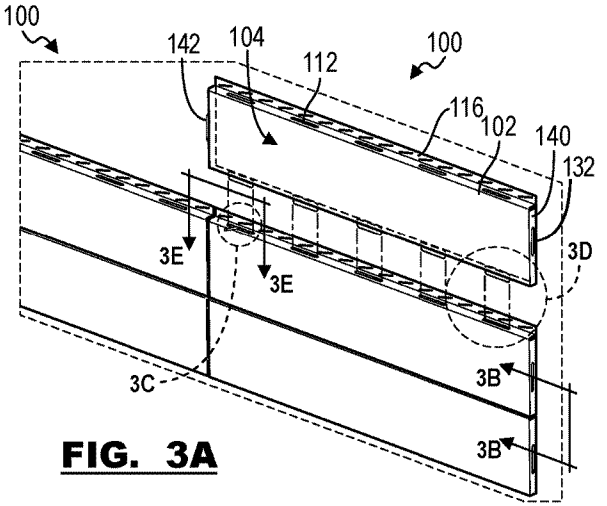
FIGS. 3A, 3B, 3C, 3D, and 3E are schematic representations of one variation of the exterior cladding system.
Figure 3C:
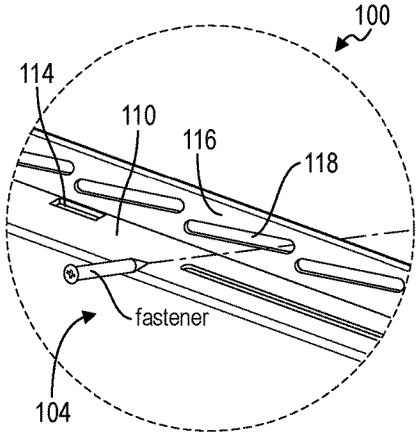

A set of panels in the exterior cladding system 100 can be installed on a wall of a commercial building, a residential building, a garage, a retaining wall, a temporary structure, a mobile structure, etc. to form an exterior façade. Panels can be installed over walls constructed from wood studs, folded steel studs, concrete, foam, or any other wall or building material or composition, such as shown in FIGS. 4, 7A-7E. Furthermore, panels in the exterior cladding system 100 can be installed in a staggered (e.g., brick lay) pattern—such as in a horizontal configuration (shown in FIG. 8) or in a vertical configuration—in a square pattern (as shown in FIG. 3A), or according to any other pattern or configuration.

Generally, a panel within the exterior cladding system 100 is configured to be installed on a wall structure with a limited number of fasteners and a limited number of different fastener types. For example, a panel can be configured to install on an adjacent wall structure with threaded fasteners (and shims as needed) exclusively and without additional clips, furring strips, standoff channels, or other hanging systems to mount the panel on the adjacent wall structure or to align the panel with an adjacent panel. Panels in the exterior cladding system 100 can therefore define various features that cooperate to simplify installation and reduce installation time of the exterior cladding system 100, thereby easing manual installation and limiting installation costs for the installation.

For example, a first panel within the exterior cladding system 100 can feature a hang tab defining multiple fastener bores in the form of elongated slots—angularly offset from the edge of the upper flange—that enable an installer to find a vertical stud and/or avoid sheathing gaps and window flanges when driving fasteners through the fastener bores and into an adjacent wall structure in order to hang the first panel. The lower end of a second panel installed over the first panel can conceal the hang tab and fasteners of the first panel; an installation of panels can thus form a smooth, fastener-free façade over the wall structure. A panel within the exterior cladding system 100 also features lock tabs extending from its lower flange and receivers along its upper flange; when assembled over a wall structure, the lock tab of a first panel is constrained by a corresponding receiver of a second panel below. Panels across an installation can thus interlock, thereby condensing fastener distribution across each panel (i.e., to a hang tab of a panel exclusively) and ease installation of panels over the wall structure.

A panel within the exterior cladding system 100 also includes a set of strikers that extend from its lower flange and are configured to contact the upper flange of a second panel below to set a consistent offset (or "gap") between the lower edge of the first panel and the upper edge of the second panel within an installation over a wall structure. Strikers and upper flanges of panels in the exterior cladding system 100 can therefore cooperate to eliminate a need for an installer to manually set a gap between two adjacent panels, such as with shims or an offset gauge, thereby simplifying installation of these panels while maintaining highly-consistent gaps between panels across the installation.

A panel within the exterior cladding system 100 is described herein as including an upper flange, including a lower flange, and configured for installation in a horizontal configuration in which the upper flange of the panel is arranged substantially parallel to the horizon with the upper flange arranged vertically above the lower flange. For example, a panel within the system can define a rectangular face with the upper flange extending from one long side of the rectangular face and with the lower flange extending from the opposite long side of the rectangular face, and the panel can be installed with each long side of the face substantially parallel to the horizon. However, it is understood that a panel within the exterior cladding system 100 can be installed in any other orientation. For example, a panel described herein can be installed with the long sides of its face substantially perpendicular to the horizon (e.g., with the upper and lower flanges arranged vertically over the wall structure) or with the long sides of the face set at an angle of 30° from the horizon. Therefore, a panel in the exterior cladding system 100 can be installed in a horizontal configuration with the upper flange above the lower flange and parallel to the horizon, in an angled configuration with the upper and lower flanges angularly offset from the horizon, in a vertical configuration with the upper and lower flanges substantially perpendicular to the horizon, in an inverted configuration with the lower flange above the upper flange and parallel to the horizon, or in any other suitable configuration.

3. Panel Construction

A panel within the exterior cladding system 100 can define a unitary structure. In one implementation, a panel 102 in the exterior cladding system 100 is constructed of cut and formed sheet metal, such as of aluminum, steel, tin, copper, zinc, or any other metal material suitable for residential or commercial exterior cladding. The panel 102 can be constructed from a flat sheet of material by laser cutting, by waterjet cutting, by plasma cutting, by punching (e.g., in a CNC-operated turret punch), or by any other suitable process. The flanges, tabs, and other features of the panel 102 can then be formed by bending, stamping, or drawing, as described below. Alternatively, a panel within the exterior cladding system 100 can be fabricated (e.g., assembled, fastened, brazed, welded) from discrete sheet metal components.

A panel can be constructed of sheet metal of a gauge (i.e., thickness) sufficient to substantially resist deflection of the panel 102 (e.g., less than 0.010" per linear foot) when installed on a wall structure exhibiting nonlinearities, such as a wall structure that is out of level by as much as one inch in twenty linear feet. For example, the panel 102 can be constructed from 14-gauge sheet steel. Alternatively, the thickness of the panel 102 can be selected to isolate the panel 102 from surface variations or other non-uniformities of the surface of the wall structure on which the panel 102 is installed, thereby reducing or eliminating a need for installation of furring strips between the panel 102 and the wall structure during installation. For example, the thickness of the panel 102 can be selected to achieve at least a minimum ratio of thickness of the panel 102 to surface area of the face 104 of the panel 102 (or to panel width or panel length) in order to ensure sufficient rigidity of the panel 102.

In other implementations, panels in the exterior cladding system 100 can be molded, formed, or cast in fiberglass, in plywood, in fiber-filled or fiber-less magnesium oxide, in fiber cement, or in any other suitable material. However, a panel in the exterior cladding system 100 can be constructed in any other suitable material and according to any other suitable method or technique.

4. Panel Face

As shown in FIG. 1, a panel within the exterior cladding system 100 includes a face 104 that defines an external surface of the panel 102 that is visibly dominant once the panel 102 is installed on a wall structure. The exterior cladding system 100 can include panels with faces defining square or rectangular planar areas, such as for installation over a planar rectilinear wall surface to form a planar façade over and offset from the wall surface. However, panels within the system can include faces defining any other shape or other combination of shapes (e.g., a combination of panels with hexagonal and square faces), as described below.

The face 104 of a panel 102 can be solid, that is, continuous across its width and height. Alternatively, a panel can feature one or more reliefs across its face. For example, a panel can include round, curvilinear, or rectilinear perforations (e.g., "cutouts") patterned across its face, such as in the form of a geometric pattern or a silhouette of a figure or other object, and shown in FIG. 10. In another example, a panel can include multiple dimples—approximately hemispherical in geometry—in a rectilinear array across its face.

5. Upper Flange and Hang Tab

The upper flange 110 of a panel within the system extends from an upper edge of the face of the panel and defines a receiver 112. A hang tab of the panel defines a fastener bore and extends from the upper flange 110 of the panel substantially parallel to the face of the panel and at a first depth from the face. Generally, the upper flange 110 functions to enhance rigidity of the top edge of the panel (e.g., to resist bending about a Y-axis of the panel) and to offset the hang tab of the panel aft of its face such that, when the panel is fastened to the wall structure by fasteners passing through the hang tab, the face of the panel is offset from the wall structure. The upper flange 110 further defines one or more receivers 112, such as in the form of elongated slots, configured to receive and to constrain lock tabs of a second panel installed above, as described below.

In one variation, a panel can include a hang tab that defines a series of fastener bores along its length. One or more woodscrews, sheet metal screws, concrete screws, rivets, and/or other fasteners can be passed through fastener bores along the hang tab and embedded in an adjacent wall structure in order to hang the panel on the wall. In one implementation, each fastener bore along the hang tab defines an elongated slot, wherein the long axis of each fastener bore is non-parallel to (i.e., angularly offset from) the long edge of the hang tab. Each fastener bore can thus provide both horizontal and vertical flexibility in the placement of a fastener therethrough. In one example, for a panel of a nominal width of 110" (2.794 m) and a hang tab that spans the full width of the panel, the panel can feature twenty-seven fastener bores—each defined an elongated slot—spaced evenly along the hang tab, wherein each fastener bore is 3.75" (95.3 mm) in width along its long axis, and wherein the long axis of each slot is set at an angle of 15° from the long edge of the hang tab.

For example, a wall may be constructed of vertical studs, horizontal top plates, and horizontal base plates, and an installer may benefit from horizontal and/or vertical flexibility when placing a fastener through the hang tab of a panel and into the adjacent wall structure. A fastener bore in the hang tab can therefore define an elongated slot of length sufficient to enable an installer to drive a fastener through the fastener bore at a lateral position aligned with an approximate center of a vertical stud in the adjacent wall structure. The fastener bore can also be inclined along the hang tab—that is, defining a long axis angularly offset from the end of the face of the panel—at an angle sufficient to enable the installer to drive a fastener through the fastener bore at a vertical position substantially aligned with a center of a top plate or other horizontal stud or beam in the adjacent wall structure while also accommodating for tolerances in building construction and panel fabrication, as shown in FIGS. 3C, 7C, 7D, and 7E. A panel in the exterior cladding system 100 can therefore include a hang tab that defines one or more fastener bores of a geometry enabling relatively simple, structural installation of the panel onto a wall structure.

Alternatively, the hang tab can define a number of fastener bores sufficient to hang the panel from fasteners driven into exterior wall sheathing (and not necessarily into a wall stud). For example, a panel 110" in width can be hung from a wall structure sheathed in ⅝" exterior-grade plywood by ten ¾"-long stainless steel wood screws driven through ten fastener bores in the hang tab and into the plywood sheathing. In this and other variations, the hang tab can feature round, square, rectangular, or ovular fastener bores, hooks, or other features of any other geometry capable of receiving a fastener and of transferring a vertical load (e.g., weight) of the panel into the fastener (and thus into the wall structure).

Furthermore, the hang tab of a panel can feature a number of fastener bores (or slots, hooks, or other features) sufficient to accommodate various different environments necessitating different numbers and/or types of fasteners to join the panel to a wall structure. For example, hang tabs of panels in the exterior cladding system 100 can feature a preset (e.g., standard) number of fastener bores to enable these panels to be installed at both low building elevations (e.g., below 50' above ground level) and at high building elevations (e.g., above 50' above ground level). In this example, a panel in the exterior cladding system 100 can be installed with one fastener per 32" span along the hang tab if the panel installed below 50' above ground level, and the panel can be installed with one fastener per 16" span along the hang tab if the panel is installed above 50' above ground level. In this example, each panel 102 in the exterior cladding system 100 can include a hang tab that defines fastener bores on 16" centers in order to accommodate installation requirements for both low and high installation cases.

6. Lower Flange, Lock Tab, and Striker

A panel in the exterior cladding system 100 includes: a lower flange 120 that extends from a lower edge of the face of the panel; and a lock tab 122 that extends from the lower flange 120 opposite the upper flange by a first height and is offset from the face by a second depth less than the first depth. Generally, a panel 102 in the exterior cladding system 100 includes a lower flange 120 configured to enhance the rigidity of the lower edge of the face of the panel and to offset one or more lock tabs 122 behind the face of the panel by a distance corresponding to a depth of receivers in upper flanges of other panels in the exterior cladding system 100. Thus, when an upper panel in the exterior cladding system 100 is installed over (i.e., vertically above) a lower panel in the exterior cladding system 100, a lock tab 122—extending below the upper panel and offset behind the face of the upper panel by the lower flange 120 of the upper panel—can engage (e.g., partially pass through) a receiver in the upper flange of the lower panel below; the receiver in the lower panel can thus constrain the lock tab 122 of the upper panel above and prevent the lower edge of the upper panel from pivoting outwardly from the wall structure, as shown in FIG. 2.

Therefore, the lock tab 122 of a first panel functions to engage (e.g., slide into) the receiver of a second panel below when the first panel and the second panel are installed on a wall structure. The receiver of the second panel constrains the lock tab 122 of the first panel to prevent the first panel from pivoting outwardly about fasteners mounting the hang tab of the first panel to the wall structure, such as in the presence of wind. Thus, when installed, the first panel can be constrained: in translation along a Y-axis (i.e., vertically) by fasteners passing though the hang tab; in translation along an X-axis (e.g., horizontally) translation by a receiver of a second panel below interfering with lateral movement of the lock tab 122 of the first panel; in translation along a Z-axis by the back surface of the hang tab; in rotation about the Y-axis rotation by two or more fasteners compressing the back surface of the hang tab against the surface of the wall structure; in rotation about the X-axis by interference between the lock tab 122 of the first panel and the receiver in the second panel below; and in rotation about the Z-axis by one or more strikers 124 extending from the lower flange 120 of the first panel and contacting the upper flange of the second panel below.

Figure 3D:
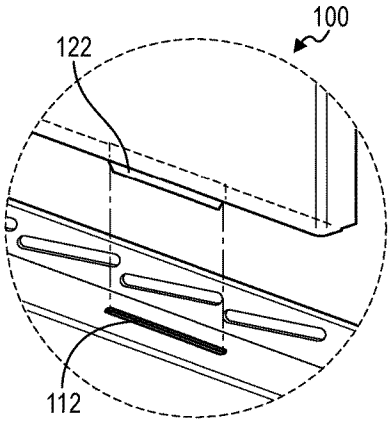
Figure 3B:
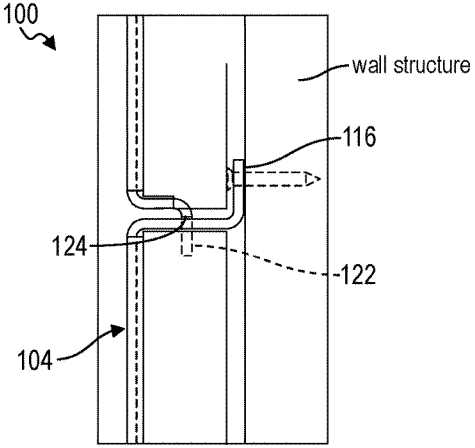

As shown in FIGS. 3A and 3B, the exterior cladding system 100 can include a set of panels in which each panel in the set includes a lock tab 122 extending from its lower flange at a depth from its face approximately equivalent to a depth of receivers from faces of other panels in the set. Thus, when the lock tab 122 of one panel is set in the receiver of an adjacent panel, faces of panels in the installation can form a substantially planar surface over the adjacent wall structure, as shown in FIG. 2. Alternatively, the exterior cladding system 100 can include a set of panels in which each panel 102 in the set includes a lock tab 122 set at a depth from its face greater than the standard depth of receivers from faces of panels in the set such that, when multiple panels in the set are installed over a wall structure, the lower edge of the face of a panel is declined outwardly from the wall structure (or vice versa for lock tabs 122 set at less than the standard depth of receivers in upper flanges of panels in the set). In this variation, faces of the set of panels thus installed over a wall structure can cooperate to form a variegated surface, such as in the form of a sawtooth profile. Furthermore, in this variation, bend angles of the upper flange, the hang tab, the lower flange 120, and the lock tab 122 of each panel 102 in the set can correspond to a difference between the depth of hang tabs and the depth of receivers from faces of panels in the set such that lock tabs 122 of panels slide substantially vertically downward (rather than at an angle) into receivers of panels below during installation and such that backs of hang tabs of these panels lie substantially flush with a substantially planar wall surface (e.g., exterior sheathing) once installed.

In one implementation, a panel in the exterior cladding system 100 includes n lock tabs 122 of width X spaced apart by distance X along the length of the lower flange 120 and spaced from a short edge of the face by distance X. For example, a panel of a nominal width of 110.0" (2.794 m) can feature five lock tabs 122 spaced evenly (e.g., uniformly distributed) along the lower flange 120 of the panel. In this example, each lock tab 122 on the panel can be 10.0" (254 mm) in width, edges of adjacent lock tabs 122 can be spaced apart by 10.0" (254 mm) (e.g., a 20.0" center-to-center distance), and outer edges of lock tabs 122 on the panel can be set in from each edge of the panel by 10.0" (254 mm). In this example, the upper flange of the panel (and other panels within the exterior cladding system 100 can similarly feature five rectangular receivers spaced evenly along the lower flange 120 of the panel, wherein each receiver is 10.1" in width (to allow the receiver to engage a lock tab with a tolerance of 0.1"+/−0.1"), wherein edges of adjacent receivers are spaced apart by 9.9", and wherein the outer edges of receivers are set in from the edge of the panel by 9.95". However, a panel within the exterior cladding system 100 can include any other number of lock tabs 122 and receivers of any other geometry or arrangement.

Furthermore, in this example, a lock tab 122 of a panel in the exterior cladding system 100 can be laterally undersized for (i.e., of a width less than a width of) a corresponding receiver in a second panel installed below, such as by 0.3" (7.6 mm), in order to permit an installer to set a vertical gap between laterally adjacent panels, such as by tightening fasteners in a panel's hang tab once a target vertical gap between the two laterally adjacent panels is achieved by permanent or temporary shims placed therebetween. Alternatively, lock tabs 122 of panels in the exterior cladding system 100 can be sized for loose running fit in corresponding receivers of other panels in the exterior cladding system 100. For example, an upper flange of a first panel can define receivers 0.025" oversized in width and depth from the width and thickness of a lock tab 122 of a second panel installed thereover in order to compensate for manufacturing tolerances and to ease assembly of the second panel into the first panel.

Figure 10:
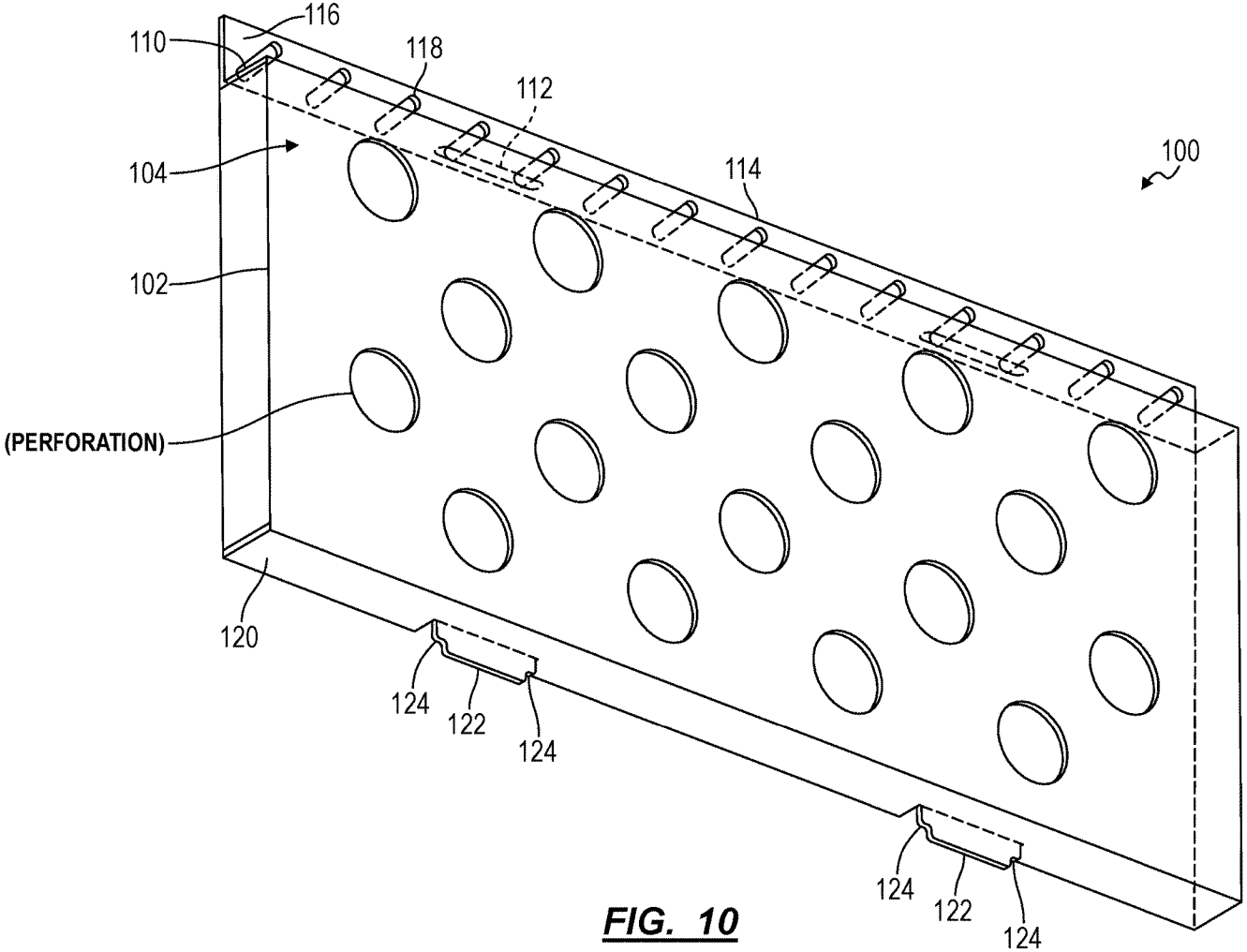
FIG. 10 is a schematic representation of one variation of the exterior cladding system.

A panel in the exterior cladding system 100 can also include a striker 124 extending from its lower flange 120 opposite its upper flange by a second height less than the first height of a lock tab 122 extending from the lower flange 120, as shown in FIGS. 1H, 3B, and 10. Generally, the striker 124 of a first panel functions to engage (e.g., rest on, contact) the upper flange of a second panel below in order to set an offset distance (or "gap") between the lower edge of the first panel and the upper edge of the second panel. For example, a first panel can include a striker 124 integral with and extending from each side of each lock tab 122 of the first panel such that—when lock tabs 122 of the first panel are installed into receivers of a second panel—a strikers 124 extending from the lower flange of the first panel bottoms on (i.e., rests on) the upper flange of the second panel just beyond the edge of its corresponding receiver in the upper flange of the second panel. The strikers 124 of the first panel can thus cooperate to set a distance with which lock tabs 122—extending from the lower flange of the panel—insert into corresponding receivers in the upper flange of the second panel. The strikers 124 of the first panel can thus set a gap between the lower edge of the first panel and the upper edge of the second panel, as shown in FIGS. 3A, 3B, and 10.

In the above example in which a panel in the exterior cladding system 100 includes n lock tabs 122 of width X spaced apart by distance X along the length of the lower flange 120, the panel can include a striker 124 that extends laterally from a side of a lock tab 122 of the panel by a proportion of width X (e.g., 10% of X) and that extends vertically from a distal end of the lower flange 120 toward a distal end of the adjacent lock tab 122 by a target gap height (e.g., 0.125" (or 3.175 mm)) between the lower edge of the panel and the upper edge of a panel below when the panels are installed. Therefore, like panels in the exterior cladding system 100 can include: receivers of a first length; lock tabs 122 of a second length less than the first length (e.g., 0.1" less); and lock tabs 122 and integrated strikers 124 of a combined length greater than the first length (e.g., 0.5" greater) such that strikers 124 on each side of a lock tab 122 extend 0.25" (6.3 mm) (on average) beyond each end of an adjacent receiver.

In one implementation, for a panel with a single (e.g., a wide) lock tab 122, the panel can feature one striker 124 on each side of the lock tab 122 in order to set even spacing between the lower edge of the panel and an upper edge of an adjacent panel. Alternatively, for a panel with multiple lock tabs 122, the panel can feature one striker 124 on each side of each lock tab 122, one striker 124 on one end of each lock tab 122, a striker 124 on the outer ends of the two outermost lock tabs 122, or two or more strikers 124 in any other configuration or position along its lower flange 120 in order to set a consistent lateral gap between the lower edge of the panel and the upper edge of an adjacent panel installed below.

A striker 124 and a lock tab 122 of a panel can thus define a unitary structure. In particular, the lock tab 122 and the striker 124 of a panel can be cut and folded in-unit. For example, the perimeter and internal areas of a flat sheet of steel (or aluminum, etc.) can be trimmed with a laser cutter (or a waterjet, a punch, etc.), as described above, to create features in the sheet subsequently formed into lock tabs 122 and strikers 124. In this example, the lower edge of the sheet can define a serrated profile, including rectangular sections with chamfered (or filleted) corners extending from a long edge of the sheet (i.e., the edge of the lower flange 120) to define lock tabs 122 once the sheet is formed (i.e., bent) into a completed panel. In this example, the sheet can also include a shoulder extending from the linear edge of the sheet along a short side of a rectangular extension to define a striker 124 once the sheet is formed into a completed panel. In particular, before the sheet is formed, the length of the shoulder (to become a striker 124) extending from the lower edge of the sheet can be less than the length of an adjacent rectangular extension (to become a lock tab 122) extending from the same lower edge of the sheet. In this example, a bend relief can also be cut in a corner between the shoulder and the linear edge to improve bend accuracy when the shoulder and the rectangular extension are formed (e.g., bent) along the linear edge of the sheet. Sections of the sheet are then formed to create the lower flange 120, the lock tab 122, and the striker 124 in the panel, such as by air bending, bottom bending, or coining. In one example, the lower flange 120 is bent (e.g., to a 90° or 93° angle, as described below), such as in a sheet metal break or by coining with a punch tip in a press, and the rectangular extension and the shoulder can then be formed into a lock tab 122 and a striker 124 by a similar coining process. Alternatively, once the lower flange 120 is formed, the rectangular extension and the adjacent shoulder can then be captured in a sheet metal break (e.g., a finger break) with an edge of a bend die parallel to the linear edge and offset toward the shoulder by a portion (e.g., half) of a bend radius; the sheet metal break is then actuated to simultaneously form the lock tab 122 and the striker 124. However, the lower flange 120, the lock tab 122, and the striker 124 can be formed in any other way, by any other process, and in any other order.

Alternatively, a panel in the exterior cladding system 100 can include one or more strikers 124 that are distinct from lock tabs 122 extending from the lower flange 120 of the panel. For example, the panel can include discrete lock tabs 122 extending from the lower flange 120, as described above, and the panel can include discrete lanced and formed features defining two or more strikers 124 extending from the lower flange 120 of the panel separately from the lock tabs 122. Yet alternatively, a panel can define one or much such discrete strikers 124 extending from its upper flange and configured to set a gap between the upper edge of the face of the panel and the lower edge of the face of a second panel above by contacting the lower flange 120 of the second panel. However, a panel in the exterior cladding system 100 can include one or more integrated strikers 124 of any other form, geometry, or position on the panel. A panel in the exterior cladding system 100 can also include a discrete striker 124 formed separately from the panel and subsequently installed on the panel, such as by welding (e.g., spot-welding), riveting, fastening with a threaded fastener, or capturing with a feature formed directly into the panel.

7. Secondary Flanges

Figure 3E:
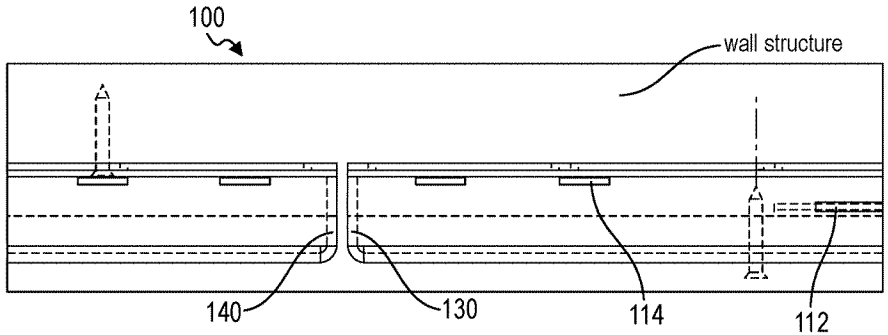

In one variation, a panel within the exterior cladding system 100 further includes one or more secondary flanges, as shown in FIGS. 3D and 3E. In this variation, a panel can include secondary flanges along its vertical sides to enhance rigidity of the vertical edges of the face of the panel and to resist bending about an X-axis of the panel.

In one implementation, a panel defining a rectangular face can include a left flange 130 extending from a left side of its face and a right flange 140 extending from a right side of its face. For example, a panel can include a left flange 130 bent at 90° from the face of the panel and extending behind the face by a depth less than or equal to the depth of the hang tab from the face of the panel. The left flange 130 can extend along the full length of the left side of the panel and can be formed by air bending, bottom bending, coining, or any other forming process. The right flange 140 can define a similar geometry, can similarly extend behind the face of the panel, and can be similarly formed. Furthermore, for a panel defining a rectangular exterior face, the left flange 130 can be parallel to the right flange 140 and perpendicular to the upper flange. However, a panel can include an integrated left flange 130 and/or an integrated right flange 140 of any other geometry.

In the foregoing implementation, the left and right flanges 130, 140 can cooperate to increase rigidity of the panel, thereby reducing deflection of the panel about an X-axis of the panel when installed on a wall structure. For example, the thickness of the panel, the length and width of the panel, and dimensions of the upper, lower, left, and right flanges 130, 140 can be selected to achieve less than a threshold deflection about X- and Y-axes of the panel (e.g., less than 0.01" per foot in any dimension) when a prescribed number of fasteners are sunk through fastener bores in the hang tab during installation.

Furthermore, in this variation, the left flange 130 can feature one or more receivers similar to the receiver(s) in the upper flange of the panel, and the right flange 140 can feature one or more lock tabs and/or strikers similar to the lock tab(s) and striker(s) extending from the lower flange of the panel (or vice versa), as shown in FIG. 3A. For example, a panel in the exterior cladding system 100 can include: a left flange 130 extending from a left edge of the face and defining a secondary receiver 132; a right flange 140 extending from a right edge of the face opposite the left edge of the face; and a secondary lock tab 142 extending from the right flange 140 opposite the left flange 130 by a third height and offset from the face by a third depth less than the first depth of the upper flange. In this example, a first panel in a set of panels in the exterior cladding system 100 can be installed adjacent a second panel with the right flange 140 of the first panel facing the left flange 130 of the second panel with a secondary lock tab 142 extending from the right flange 140 of the first panel passing through and constrained by the receiver in the left flange 130 of the second panel. Thus, when a first panel is installed immediately to the left of a second panel, the right lock tab of the first panel can pass through and can be constrained by the left receiver of the second panel. In particular, secondary lock tabs 142 and secondary receivers 132 along secondary flanges of panels in the exterior cladding system 100 can thus cooperate to interlock laterally-adjacent panels across an installation, whereas (primary) lock tabs and (primary) receivers along lower and upper flanges of panels can interlock vertically-adjacent panels across an installation, as described above. In this variation, the primary and secondary receivers 112, 132 and lock tabs can be sized to enable an installer to pivot a next panel into position adjacent a panel below and a panel to the side of the next panel. For example, panels in the exterior cladding system 100 can define receivers that are 50% longer than their corresponding lock tabs.

In this variation, each panel 102 in the exterior cladding system 100 can further include a secondary striker 144 extending from its right flange 140 opposite its left flange 130 by a fourth height less than the third height of the secondary lock (e.g., by a distance corresponding to a target vertical gap between horizontally-adjacent panels). Thus, in the foregoing example, the secondary striker 144 of the first panel can contact the left flange 130 of the third panel to set a gap between its right edge and the left edge of the second panel. A panel in the exterior cladding system 100 can thus include a right striker that contacts the left flange 130 of an adjacent panel to set a (substantially uniform) vertical gap between the two panels. For example, for each panel 102 in the exterior cladding system 100, a secondary striker 144 extending from a right (or left) flange of a panel can extend beyond the adjacent vertical edge of the face of the panel by a distance substantially similar to a distance that a (primary) striker extends from the adjacent horizontal edge of the face of the panel in order to set a substantially uniform gap around all edges of all panels in an installation. Alternatively, a secondary striker 144 extending from a right (or left) flange of a panel in the exterior cladding system 100 can extend beyond the adjacent vertical edge of the face of the panel by a distance substantially dissimilar from a distance that a (primary) striker extends from the adjacent horizontal edge of the face of the panel in order to set different gaps between vertical edges of horizontally-adjacent panels and between horizontal edges of vertically-adjacent panels in an installation.

However, a panel within the exterior cladding system 100 can include a secondary flange of any other geometry and including any other number or form of secondary lock tabs 142, secondary strikers 144, and/or secondary receivers 132. A panel in the exterior cladding system 100 can similarly include a flange riveted, welded, or fastened in any other way to the interior of the panel (i.e., opposite the face of the panel), such as along a vertical edge of the panel or extending diagonally from one corner of the panel to an opposite corner of the panel.

8. Starter Panels

In one variation, the exterior cladding system 100 includes a second set of starter panels 150. In this variation, the second set of panels can include starter panels, wherein each starter panel 150 includes: a face; an upper flange extending from an upper edge of the face and defining a receiver; a hang tab extending from the upper flange substantially parallel to the face, offset from the face by the first depth, and defining an upper fastener bore; a lower flange extending from a lower edge of the face; and a mounting tab extending from the lower flange and defining a lower fastener bore. In this variation, both the top edge and bottom edge of the starter panel 150 can be fastened to the wall structure (e.g., by a first set of fasteners passing through the upper fastener bore(s) and by a second set of fasteners passing through the lower fastener bore(s)). Furthermore, the lock tab of the first panel installed above the starter panel 150 can pass through and can be constrained by the receiver of the starter panel 150; and the striker of the first panel can contact the upper flange of the starter panel 150 to set a gap between the upper edge of the starter panel 150 and the lower edge of the first panel. Generally, the exterior cladding system 100 can include one or more starter panels 150 configured for installation on a wall structure prior to other panels in order to define lateral and vertical positions of panels subsequently installed on the wall structure.

Figure 4:
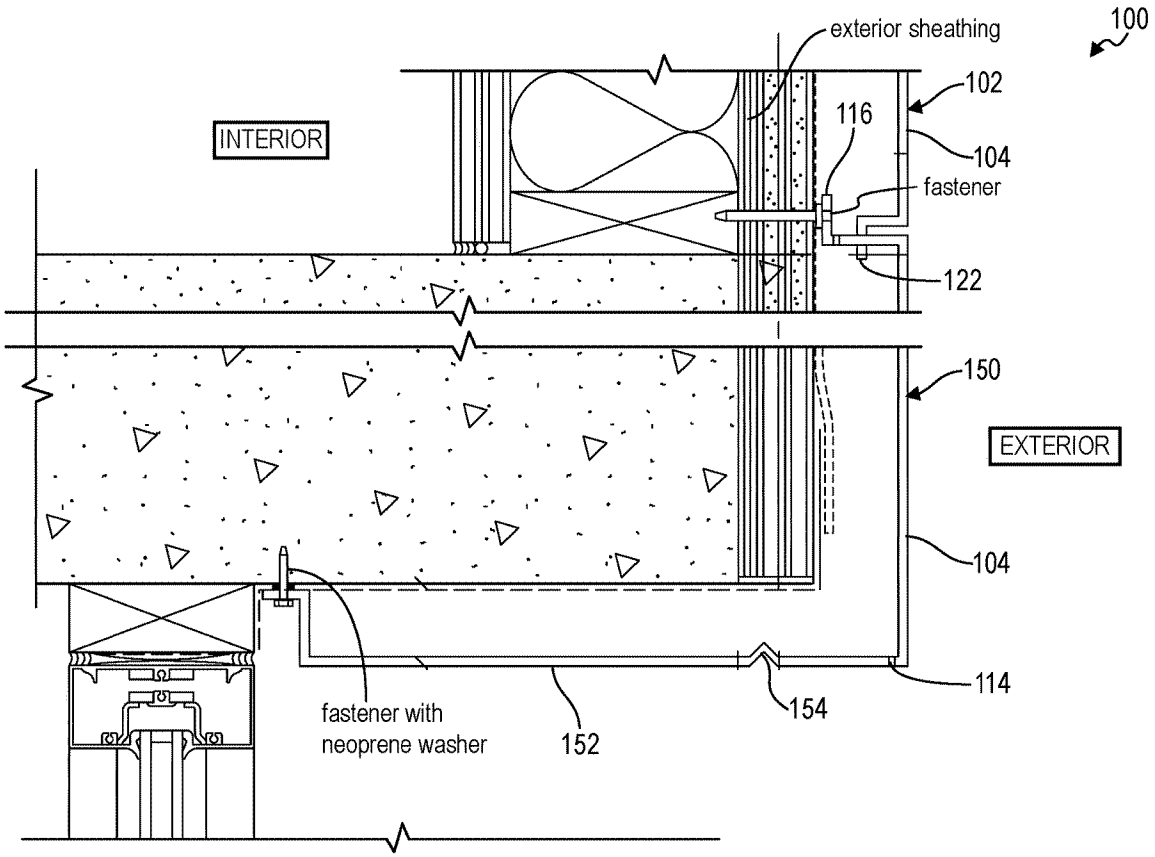
FIG. 4 is a schematic representation of one variation of the exterior cladding system.

In one implementation, a starter panel 150 includes an upper flange, a hang tab, fastener bores, and receivers, as described above, but further includes an integrated soffit 152 that extends from the lower edge of the face of the panel, as shown in FIG. 4. In this implementation, because the starter panel 150 may define a lowest panel within an installation on a wall structure (i.e., because the lower edge of the starter panel 150 may not be installed over a top edge of another panel below), the starter panel 150 can exclude lock tabs and can instead include one or more fastener bores along its lower flange. For example, the starter panel 150 can include a lower flange that defines a soffit 152 and that extends substantially horizontally behind the face of the starter panel 150 to abut an adjacent wall structure when installed. In particular, the lower flange can define a set of fastener bores—such as in the form of round bores or elongated slots—and an installer can pass fasteners vertically upward through these fastener bores and into the adjacent wall structure to secure the lower flange of the starter panel 150 to the wall structure, as shown in FIG. 4. Alternatively, the starter panel 150 can include a fastening flange extending downward from its lower flange and defining a set of fastener bores through which an installer may pass fasteners horizontally into the adjacent wall structure to secure the fastening flange of the starter panel 150 to the wall structure.

Furthermore, a horizontal section of the starter panel 150 defining a soffit 152 can be perforated to permit air flow behind the starter panel 150 and up the wall structure between back sides of installed panels and a vapor barrier applied over the wall structure, such as in order to evacuate moisture from this cavity between panels and the adjacent wall structure.

The starter panel 150 can also include an integrated drip channel. For example, the face of the starter panel 150 can define: a crease between its upper flange and its lower flange to form a vertical section (in-plane with the face of a panel installed thereover) and a horizontal section (e.g., a soffit 152); a drip rail 154 between the crease and the lower flange of the third panel; and a drainage port between the crease and the drip rail 154, as shown in FIG. 4. In this example, the horizontal section of the starter panel 150 can define a drip rail 154 in the form of an inverted V-groove formed along the width of the soffit 152 parallel to the crease, and the apex of the V-groove can extend vertically above the crease to inhibit communication of moisture from the crease in the starter panel 150 toward the adjacent wall structure. The drainage ports in the horizontal section of the starter panel 150 can also pass moisture—released onto the starter panel 150 by panels installed thereover or otherwise collecting behind the starter panel 150—onto the ground or onto another external structure below. For example, the starter panel 150 can include one ¼"-diameter drainage port per 6" span along each side of the V-groove to prevent collection of moisture along the horizontal section of the starter panel 150. Furthermore, in this example, the crease in the starter panel 150 can be formed at 90° or at an angle greater than 90° from its vertical section in order to draw moisture collecting inside the panel away from the wall structure and toward the crease; the starter panel 150 can thus include drainage ports along the crease, and these drainage ports can release such moisture from behind the starter panel 150.

9. Finishing and Perimeter Panel

As shown in FIG. 8, the exterior cladding system 100 can also include a finishing panel 160 that defines a lower flange, lock tabs, an upper flange, a face and a hang tab, such as described above, and that further defines a perforated section extending (substantially) horizontally from the lower flange toward the face of the panel to form an overhead soffit. In this variation, the overhead soffit of the finishing panel 160 can define features and/or geometries similar to those of a starter panel 150. Thus, when installing the exterior cladding system 100 over a wall structure, an installer can: first install a set of starter panels; then install "standard" panels including both hang tabs and lock tabs, as described above, above the starter panels, such as in a brick-lay pattern or in a series of vertical stacks; and finally finish a vertical run of standard panels with a finishing panel 160, as shown in FIG. 8. The starter panel can thus interface with a wall surface below or at the base of an installation, and the finishing panel 160 can interface with a wall surface (or roofing structure, etc.) above or at the top of the installation. In this variation, the soffit in the finishing panel 160 can include drainage ports or other perforations to permit air to flow upward between the wall structure and the installed panels and out of this cavity via these drainage ports or other perforations (or vice versa).

The exterior cladding system 100 can similarly include perimeter panels of various other geometries to finish edges of a wall structure clad with such panels. For example, the exterior cladding system 100 can include a first perimeter panel with a left flange 130 bent from its face by 135° and a second perimeter panel with its right flange 140 bent from its face by 135° such that the first and second perimeter panels can be installed on each side of an internal corner of a wall structure. In a similar example, the exterior cladding system 100 can include a first perimeter panel with its left flange 130 bent from its face by 45° and a second perimeter panel with its right flange 140 bent from its face by 45° such that the first perimeter panel and the second perimeter panel can be installed on each side of an external corner of a wall structure. Alternatively, a corner panel 164 within the exterior cladding system 100 can include a face defining a vertical 90° crease, and this corner panel 164 can include one hang tab over each perpendicular side of its face and one (or more) lock tab(s) below each perpendicular side of its face. The corner panel 164 can thus be installed over an external corner of a wall structure and can integrate with other (standard) panels on each side of the external corner.

However, the system can include perimeter panels, corner panels 164, finishing panels 160, and/or starter panels of any other geometry or configuration.

10. Water Drainage

In one variation, in order to manage moisture across and/or through a panel in the exterior cladding system 100, the upper flange and/or the lower flange of a panel can be declined away (or toward) the face of the panel, as shown in FIG. 9. In one implementation, for the exterior cladding system 100 in which panels are installed on a wall structure in a horizontal or otherwise upright configuration, the upper flange of each panel 102 in the exterior cladding system 100 can be declined downward and away from the face of the panel, as shown in FIGS. 5E and 9, in order to draw moisture away from face of panel, such as when the installation is exposed to rain or when moisture condenses on faces of the panels due to ambient temperature changes. In one example, the upper flange of a panel within the exterior cladding system 100 forms an 87° angle with the face of the panel, and the hang tab similarly forms an 87° angle within the upper flange such that the face of the hang tab is parallel to the face panel. In this example, the panel can further include one or more drainage ports 114 along the upper flange, such as along an apex between the upper flange and the hang tab (i.e., at a lowest point or line along the upper flange), as shown in FIG. 1A. The upper flange thus declined away from the face of the panel can catch moisture, dirt, and/or contaminants falling from the lower edge of a panel installed thereover in order to limit accumulation of contaminants on the face of panel, and the upper flange of the panel can pass such moisture and other contaminants downward to the upper flange of a panel installed therebelow via the drainage ports 114.

The lower flange of a panel in the exterior cladding system 100 can be similarly declined downward and away from the face of the panel in order to draw moisture away from the lower edge of the panel, as shown in FIG. 9, thereby similarly reducing deposition of contaminants onto the face of a panel installed below. For example, the lower flange of a panel in the exterior cladding system 100 can form a 93° angle within the face of the panel, and the lock tab(s) of the panel can similarly form a 93° angle within the lower flange such that a face of the lock tab is substantially parallel to the face of the panel. In this example, the upper flange of the panel can thus be substantially parallel to the lower flange of the panel, and both the upper and lower flanges can be declined away from the face of the panel. Because the lower flange of the panel is thus declined way from the face of the panel, the lower flange can draw moisture and other contaminants collecting on the lower edge of the panel back behind the panel, thereby reducing collection of such moisture and contaminants on the face of the panel and on faces of other panels below.

The lower flange of a panel can also include one or more drainage ports spaced along its length and configured to pass moisture downward to an upper flange of a panel below. Alternatively, because the lower flange on a first panel is shallower than the upper flange of a second panel below (i.e., because the lower flange of the first panel is offset behind the face of the panel less than its upper flange) and because the lower flange of the first panel is declined away from the face of the first panel, as shown in FIG. 9, the lower flange of the first panel can release moisture collecting thereover onto the upper flange of the second panel below between the hang tab and the face of the second panel. In particular, during rainfall, the first panel (installed in a horizontal configuration, as shown in FIG. 8) can draw water from its lower edge, along its declining lower flange, and toward the adjacent wall structure. The lower flange of the first panel can then dispense this water onto the upper flange of the second panel vertically below the first panel. The first panel (and other panels in the set) can therefore define a geometry that draws water away from its face in order to reduce an amount of moisture that drips from its lower edge onto the face of the second panel below and thereby reducing contamination of the face of the second panel by waterborne and airborne detritus during rainfall. Furthermore, the upper edge of the second panel—below the first panel—can catch additional water dripped from the lower edge of the first panel, and the declining upper flange can similarly draw water away from its face. Drainage ports in the upper flange (e.g., at the apex of the upper flange and the hang tab) of the second panel can then release such moisture—collected from the first panel above—down to the lower flange of the second panel and to the upper flange and a third panel below. When installed, the set of panels can therefore cooperate to draw moisture incident on faces of panels in the set behind these faces and to flow this moisture downward between the backs of these panels and the adjacent wall structure; a soffit or other perforated starter panel at the bottom of a vertical stack of panels can then discharge this moisture to the ground below.

However, a panel in the exterior cladding system 100 can include any other number or configuration of drainage ports, and the upper and lower flanges of the panel can be formed in any other way relative to its face to achieve such moisture control across an installation.

Additionally or alternatively, a panel in the exterior cladding system 100 can be installed over a wall structure with shims between the hang tab and the wall structure, thereby offsetting the hang tab from the wall structure and providing space between the hang tab and the wall structure for moisture to drain downward and along the wall structure. (Shims can also be installed between the hang tab of a panel in the exterior cladding system 100 and the wall structure in order to accommodate variations in planarity of the wall structure.)

11. Panel Geometries

In other variations, panels within the exterior cladding system 100 can define faces of other geometries and can be installed according to other patterns. A panel within the exterior cladding system 100 has been described above as defining a rectangular face configured for installation in a horizontal pattern in which the lower edge of each panel 102 defines a long edge of the rectangular face that is installed substantially parallel to the horizon. In one alternative configuration, panels within the exterior cladding system 100 define square faces configured for installation in a horizontal configuration (e.g., with their upper flange substantially parallel to the horizon), in a vertical configuration (e.g., within their upper flange substantially perpendicular to the horizon), or at any other angle relative to the horizon.

In another variation, the exterior cladding system 100 includes a combination of panels with hexagonal faces and panels with square faces. In this variation, a hex-shaped panel can include: one or more hang tabs extending from each of the upper-left edge and the upper-right edge of the face of the panel (e.g., from 270° to 330° and from 30° to 90°); a lower flange and one or more lock tabs extending from the lower edge of the face of the panel (e.g., from 150° to 210°); and an upper flange with one or more receivers extending from the upper edge of the face of the panel (e.g., from 330° to 30°). In this variation, a square panel within the exterior cladding system 100 defines sides of lengths equivalent to the length of a side of a hex-shaped panel in the system, and the square panel includes a hang tab along the upper edge of the face of the square panel and a lock tab along the lower edge of the face of the square panel. Thus, a set of square and hex panels can be patterned vertically in a linear hex-square-hex-square pattern, wherein the receiver in the upper flange of a first square panel retains a lock tab extending from the lower flange of an adjacent first hex panel, wherein the receiver in the upper flange of the first hex panel retains a lock tab extending from the lower flange of an adjacent second square panel, and wherein the second square panel is arranged over the first hex panel, which is arranged over the first square panel. However, the exterior cladding system 100 can include panels of one or more face geometries that interlock according to any other scheme when installed to form an exterior façade of a wall structure.

In another variation, the face of a panel within the exterior cladding system can be non-planar. For example, the face of a panel can be stretched, spun, stamped, or drawn to create a concave, convex, or waveform surface profile. However, a panel within the exterior cladding system 100 can define a face of any other suitable form or geometry.

12. Opening Trim

In one variation, the exterior cladding system 100 includes one or more panels, brackets, sunshade panels, and/or cover panels, etc. configured to interface with an opening in a wall structure, such as a window or door, as shown in FIGS. 5A-5G.

12.1 Sides of Openings

Figure 6B:
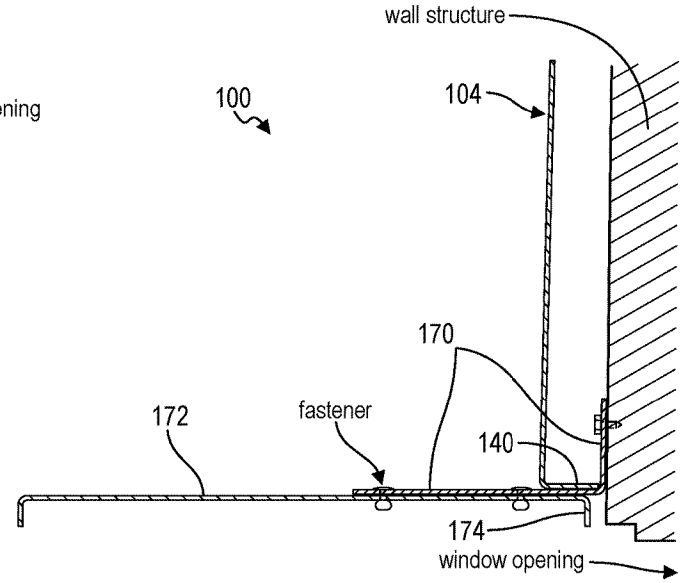
FIGS. 6A, 6B, 6C, and 6D are schematic representations of one variation of the exterior cladding system.
Figure 6A:
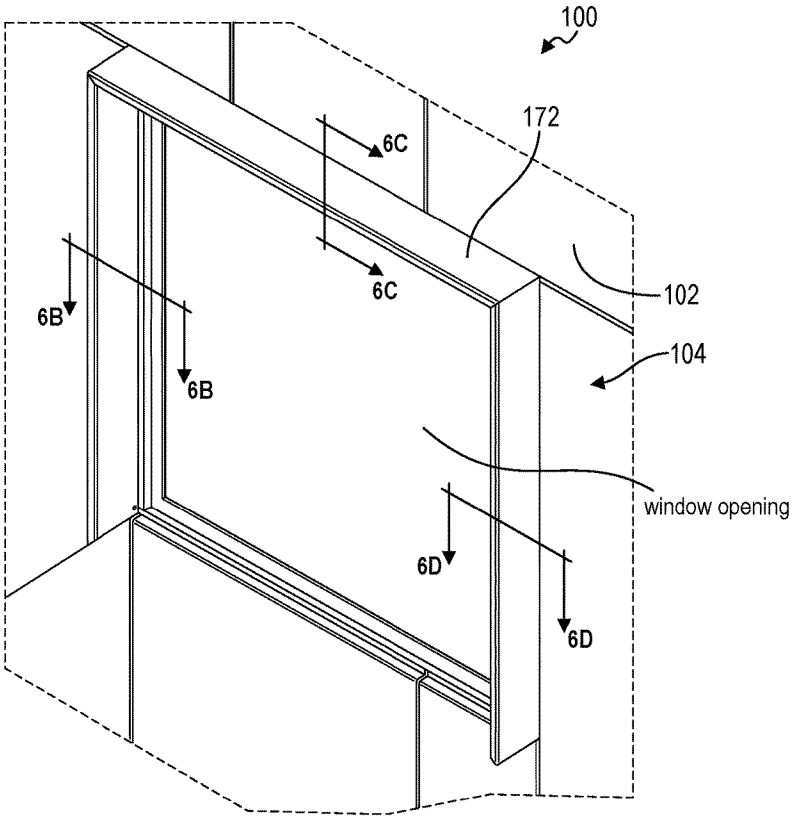

In one implementation, a first section of an L-channel bracket 170 is arranged over a window nail fin and is fastened to a stud, header, and/or ledger on one side of the window frame beyond the periphery of the window nail fin, as shown in FIGS. 6A and 6B. A second section of the L-channel bracket 170 extends outwardly from the wall structure, such as by a distance substantially similar to the depth of panels in the exterior cladding system 100. The right flange 140 of a panel installed immediately to the left of a vertical L-channel bracket 170 installed along a left side of a window (or door) can then be riveted to the second section of the L-channel bracket 170 in order to constrain and close the right side of the panel. Alternatively, the right flange 140 of the panel and the L-channel can be fastened with one or more threaded fasteners. For example, for a configuration in which the second section of the L-channel bracket 170 is interposed between the window to the right and the panel to the left, the right flange 140 of the panel can include threaded bores, PEM nuts (e.g., internally-threaded rivets) inserted into smooth bores, and any other suitable type of threaded insert substantially aligned with through-holes in the L-channel bracket 170; threaded fasteners can then be passed through the L-channel bracket 170 and into these threaded features in the right flange 140 of the panel. Yet alternatively, the L-channel bracket 170 and the right flange 140 of the panel can be assembled with self-tapping sheet metal screws or with any other fastener.

In this implementation, the second section of the L-channel bracket 170 can be of a length significantly greater than a depth of panels in the exterior cladding system 100. In particular, the second section of the L-channel bracket 170 extend outwardly from the wall structure by a distance (e.g., 10") greater than a depth of panels in the exterior cladding system 100 (e.g., 2") such that the L-channel bracket 170 forms a sunshade around the window, as shown in FIGS. 6A and 6B. In this implementation, the second section of the L-channel bracket 170 can define a solid, continuous surface or can be perforated, as described above, such as to control an amount of light passed by the second section of the L-channel bracket 170. Alternatively, the second section of the L-channel bracket 170 can extend from the wall structure by a distance substantially similar to the depth of panels in the exterior cladding system 100, and a sunshade panel 172 can be riveted or otherwise fastened to the second section of the L-channel bracket 170 to form a sunshade along the left side of the window. In this implementation, the sunshade panel 172 can include a closing flange 174 along one end and can be mounted to the second section of the L-channel bracket 170 and/or to the right flange 140 of the panel with the closing flange 174 of the sunshade panel 172 covering a gap between the window flange and the L-channel bracket 170 to form a smooth continuous surface along the left side of the window.

The left flange 130 of a panel installed immediately to the right of a second vertical L-channel bracket 170 installed along on a right side of the window can be similarly fastened to this second L-channel bracket 170, and a sunshade panel 172 integrated into or separate from the L-channel bracket 170 can similarly form a sunshade along the right side of the window.

Figure 5A:
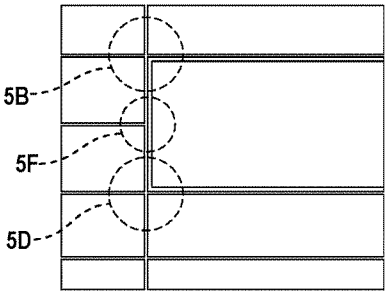
FIGS. 5A, 5B, 5C, 5D, 5E, 5F, and 5G are schematic representations of one variation of the exterior cladding system.
Figure 5B:
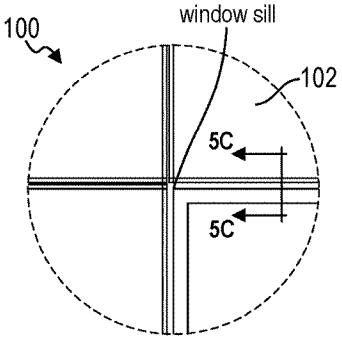
Figure 5C:
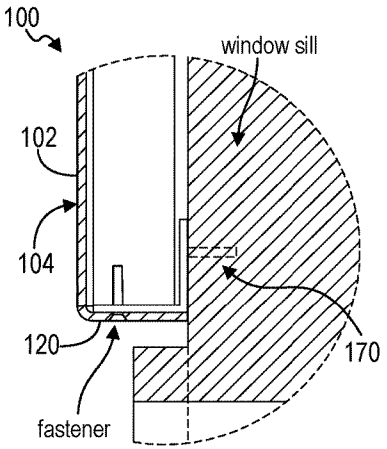
Figure 5D:
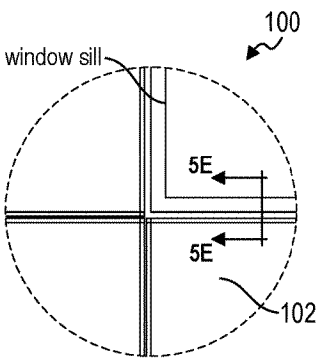
Figure 5E:
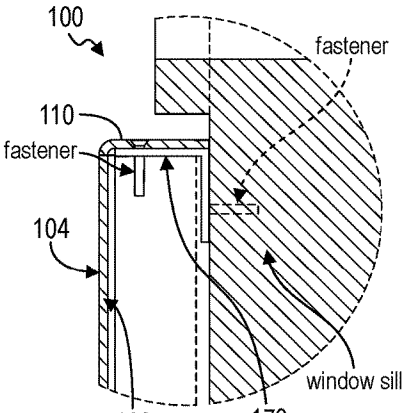
Figure 5F:
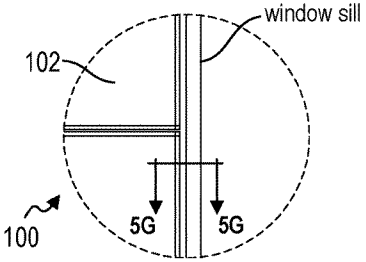
Figure 5G:
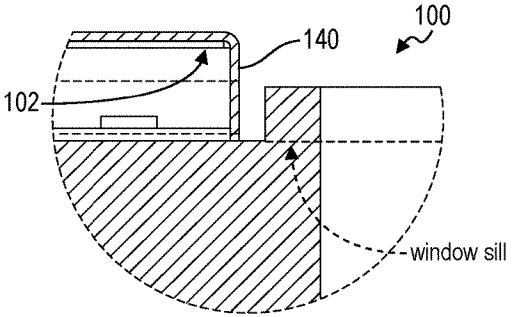

Alternatively, a panel installed to the right or left of an opening in an adjacent wall structure can be mounted to the wall structure along its hang tab, can be constrained against the wall by its lock tabs engaging receivers in a panel(s) below, and can include a right flange or left flange that floats along a vertical edge of the adjacent window sill, as shown in FIGS. 5A, 5F, and 5G.

12.2 Tops of Openings

Figure 6C:
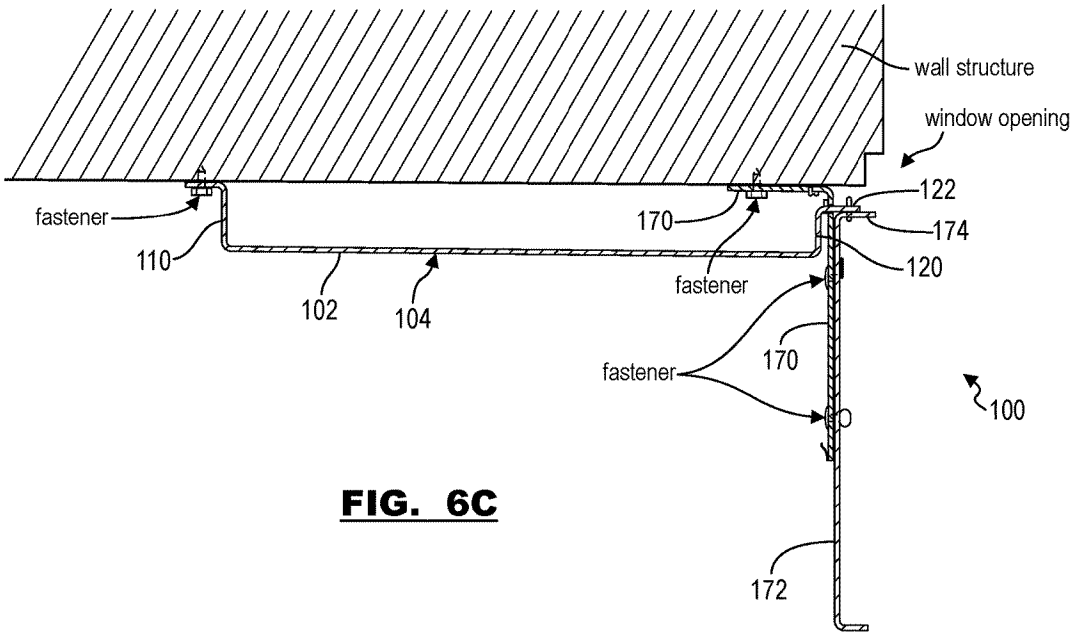
Figure 6D:
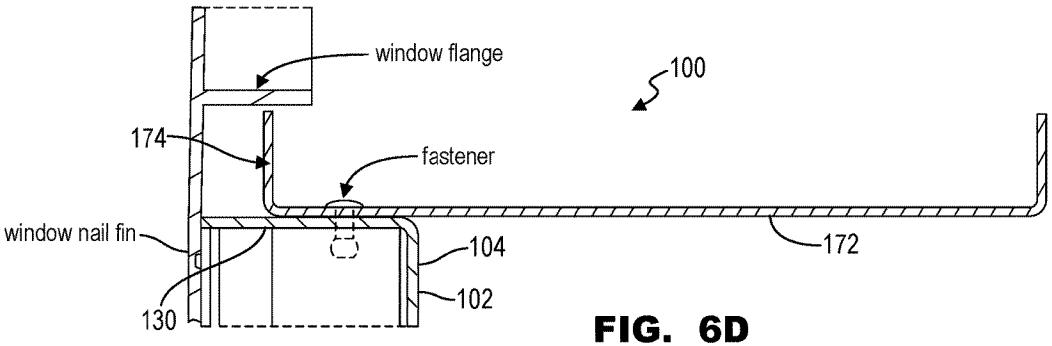
Figures 7A, 7B, 7C, 7D, 7E:
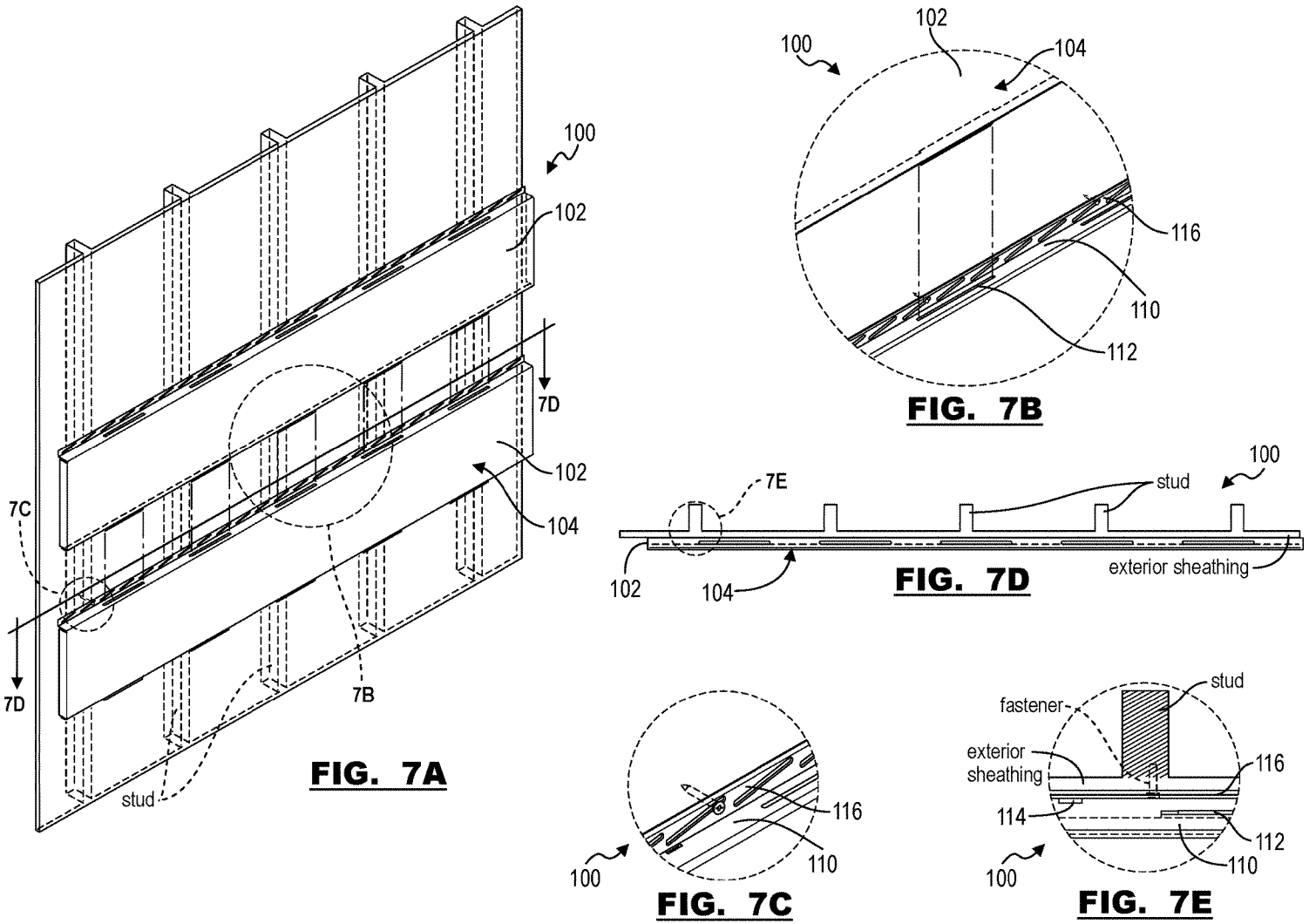
FIGS. 7A, 7B, 7C, 7D, and 7E are schematic representations of one variation of the exterior cladding system.

An L-channel bracket 170 can be similarly installed along a top of a window (or door). For example: the lower flange of a panel installed above a window can include fastener bores (e.g., through-holes, threaded inserts) but can exclude lock tabs; and the second section of the L-channel bracket 170 above the window can be riveted or otherwise fastened directly to the lower flange of the adjacent panel, as shown in FIGS. 5A, 5B, and 5C. Alternatively, the second section of the L-channel bracket 170 can include a set of receivers—like receivers in the upper flange of a panel in the exterior cladding system 100—that engage and constrain lock tabs extending from the lower flange of a panel installed thereover, as shown in FIGS. 6A and 6C. In this implementation, a sunshade panel 172—including a closing flange 174 along one end—can be riveted or otherwise fastened to the second section of L-channel bracket 170 and/or to the lower flange of the panel with the closing flange 174 of the sunshade panel 172 covering the lock tabs of the panel to form a smooth continuous surface over the adjacent window nail fin, as shown in FIGS. 6A and 6C.

Yet alternatively, a panel configured for installation above a window can include: a lower flange extending rearward from the face of the panel by a distance substantially similar to a length of the upper flange of the panel; and a second hang tab extending from the inner edge of the lower flange upward toward the upper flange. In this example, the second hang tab can include one or more fastener bores offset above the lower edge of the panel by a distance greater than a width of a window nail fin specified for the installation; and the face of the panel can include a through-bore aligned with each fastener bore in the second hang tab and of sufficient size to pass a fastener, a washer (if specified), and a tool to install the fastener and washer through the fastener bore and into the adjacent wall structure in order to fasten the lower end of the panel to the wall structure. In this example, the lower flange can also include one or more perforations, such as along an apex between the lower flange and second hang tab, to drain moisture that may accumulate over the lower flange. A solid or perforated sunshade panel 172 can then be riveted or otherwise fastened to the lower flange of this panel and/or to the second section of an L-channel bracket 170 along the top of the window to form a sunshade above the window, as described above. Alternatively, a short closing panel of depth less than the depth of panels in the exterior cladding system 100 can be riveted or otherwise fastened to a L-channel bracket 170 between the L-channel bracket 170 and the window to cover the adjacent window nail fin.

12.3 Bottoms of Openings

An L-channel bracket 170 can be similarly installed along a bottom of a window (or door). For example: the upper flange of a panel installed above a window can include one or more fastener bores (e.g., through-holes) but can exclude receivers; the hang tab of the panel can exclude a fastener bore; and the second section of the L-channel bracket 170 below the window can be riveted or otherwise fastened directly to the upper flange of the panel, as shown in FIGS. 5A, 5D, and 5E. In this implementation, the hang tab of the panel can function to cover the lower edge of the window nail fin and can cooperate with closing flanges 174 of sunshade panels 172 (or other closing panels) mounted to L-channel bracket 170*s* installed along the left, right, and top edges of the window to form a continuous surface around the window and insert from faces of panels installed on the wall structure.

Alternatively, a panel configured for installation below a window can include a hang tab extending downward (rather than upward) from the upper flange and including one or more fastener bores offset below the upper edge of the panel by a distance greater than a width of a window nail fin specified for the installation. In this implementation, the face of the panel can also include a through-bore aligned with each fastener bore in the hang tab and of sufficient size to pass a fastener, a washer (if specified), and a tool to install the fastener and washer through the fastener bore and into the adjacent wall structure in order to fasten the upper end of the panel to the wall structure.

Panels in a vertical configuration (rather than a horizontal configuration as described above) can define similar features (rotated 90° about the viewing axis of an opening) that interface with an opening in a wall structure.

12. Sunshade

In one variation, the exterior cladding system 100 includes or interfaces with a sunshade panel 172 configured to shade an opening in a wall structure. For example, the exterior cladding system 100 can include sheet metal sunshade panels 172 that fasten (e.g., with rivets) to left, right, upper, and lower flanges of panels installed around a window opening in an installation, as shown in FIGS. 6A-6D.

In another implementation, the exterior cladding system 100 interfaces with a sunshade that mounts directly to a wall structure over (or beside, under) an opening. For example, a sunshade can include: a grated area; a vertical mounting flange along one edge of the grated area and defining one or more fastener bores; and a tension boss proximal an end of the grated area opposite the mounting flange. The sunshade can be mounted to a wall structure over an opening by fixing the mounting flange to the wall structure with fasteners and by attaching the tension boss to a cable, turnbuckle, or other tensioned structure connected to the wall structure above the opening. In this implementation, the mounting boss can be arranged over an upper window nail fin arranged along the top edge of the opening. Grated openings in the sunshade can function as receivers, as described above, that receive and constrain lock tabs extending from a panel installed on the wall structure over the sunshade. Alternatively, the sunshade can include a receiver flange between the mounting flange and the grated area and defining a set of receivers configured to receive and constrain lock tabs extending from a panel installed thereover. Furthermore, in this implementation, a panel installed above the sunshade can include a tension boss welded to or formed in-unit with other features of the panel; a cable, turnbuckle, or other tensioned structure can thus be installed between the tension boss on the sunshade and the tension boss on this panel to support the panel. Alternatively, a discrete tension boss can be mounted to the wall structure (e.g., over a hang tab of a panel installed above the sunshade) and can pass through a gap between two adjacent panels above the sunshade, and a cable, turnbuckle, or other tensioned structure can be installed between the tension boss on the sunshade and this discrete tension boss to support the panel.

In this variation, the sunshade can be fabricated from metal rod, channel, plate, and/or bar, etc. Alternatively, the sunshade can be constructed from fiberglass sheet and metal L-, T-, or U-channel. However, panels in the exterior cladding system 100 can interface with a sunshade of any other form, geometry, or material.

As a person skilled in the art will recognize from the previous detailed description and from the figures and claims, modifications and changes can be made to the embodiments of the invention without departing from the scope of this invention as defined in the following claims.

We claim:

1. An exterior cladding system, comprising:

a set of panels comprising a first panel and a second panel, each panel in the set of panels comprising:

a face;

an upper flange extending from an upper edge of the face and defining a receiver;

a hang tab extending from the upper flange substantially parallel to the face, offset from the face by a first depth, and defining a fastener bore;

a lower flange extending from a lower edge of the face;

a lock tab extending from the lower flange opposite the upper flange by a first height and offset from the face by a second depth less than the first depth; and a striker extending from the lower flange opposite the upper flange by a second height less than the first height;

wherein the first panel is configured to hang from a first fastener passing through the fastener bore in the first panel and into an adjacent wall structure; and wherein the second panel is configured to hang from a second fastener passing through the fastener bore in the second panel and into the adjacent wall structure with the lock tab of the second panel passing through and constrained by the receiver of the first panel and with the striker of the second panel contacting the upper flange of the first panel to set a gap between the upper edge of the first panel and the lower edge of the second panel.

2. An exterior cladding system, comprising:

a first panel comprising:

a first face;

a first upper flange extending from a first upper edge of the first face, declining away from the first face, and defining a first receiver and a first drainage port; and a first hang tab extending from the first upper flange substantially parallel to the first face, offset from the first face by a first depth, and defining a first elongated slot; and configured to hang from a first fastener passing through the first elongated slot and into an adjacent wall structure; and a second panel comprising:

a second face;

a second upper flange extending from a second upper edge of the second face, declining away from the second face, defining a second receiver and a second drainage port; and a second hang tab extending from the second upper flange substantially parallel to the second face, offset from the second face by the first depth, and defining a second elongated slot;

configured to hang from a second fastener passing through the second elongated slot and into the adjacent wall structure; and further comprising:

a second lower flange extending from a second lower edge of the second face and declining away from the second face and configured to collect fluid passing down the second face; and a second lock tab extending from the second lower flange opposite the second upper flange by a first height, offset from the second face by a second depth less than the first depth, configured to pass through the first receiver of the first panel to constrain the second lower flange of the second panel, and configured to cooperate with the second lower flange to deposit fluid onto the first flange of the first panel between the first hang tab and the first face.

* * * * *